US007025043B2

(12) United States Patent
Tonetti et al.

(10) Patent No.: US 7,025,043 B2
(45) Date of Patent: Apr. 11, 2006

(54) METHOD FOR BALANCING THE TORQUE GENERATED BY THE CYLINDERS OF AN INTERNAL COMBUSTION ENGINE, IN PARTICULAR A DIRECT-INJECTION DIESEL ENGINE PROVIDED WITH A COMMON RAIL INJECTION SYSTEM

(75) Inventors: Marco Tonetti, Orbassano (IT); Francesco Richard, Orbassano (IT); Andrea Ruggiero, Orbassano (IT); Cesare Ponti, Orbassano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/971,771

(22) Filed: Oct. 22, 2004

(65) Prior Publication Data

US 2005/0092299 A1 May 5, 2005

(30) Foreign Application Priority Data

Oct. 23, 2003 (IT) ..... TO2003A0837

(51) Int. Cl.
*F02M 51/00* (2006.01)

(52) U.S. Cl. ..... 123/436; 123/472; 123/299; 701/103; 701/110

(58) Field of Classification Search ..... 123/436, 123/472, 299; 701/103–105, 110
See application file for complete search history.

(56) References Cited

U.S. PATENT DOCUMENTS

| | | | | |
|---|---|---|---|---|
| 4,667,634 | A | 5/1987 | Matsumura et al. | 123/357 |
| 5,647,317 | A | 7/1997 | Weisman, II et al. | 123/299 |
| 5,740,780 | A * | 4/1998 | Shimizu et al. | 123/406.22 |
| 6,209,520 | B1 * | 4/2001 | Kolmanovsky et al. | 123/435 |
| 2002/0162529 | A1 * | 11/2002 | Hasegawa | 123/299 |

FOREIGN PATENT DOCUMENTS

| | | | |
|---|---|---|---|
| DE | 198 59 074 | A1 | 6/2000 |
| EP | 0 532 419 | A1 | 3/1993 |
| EP | 1 035 314 | A2 | 9/2000 |
| WO | WO 98/07971 | | 2/1998 |
| WO | WO 01/90556 | * | 11/2001 |
| WO | WO 01/90557 | * | 11/2001 |

* cited by examiner

*Primary Examiner*—Hai Huynh
(74) *Attorney, Agent, or Firm*—Seed IP Law Group PLLC

(57) ABSTRACT

A method for balancing the torque generated by the cylinders of an internal combustion engine comprising the stages of: determining for each cylinder quantity which indicates the torque generated by the cylinder in a given engine cycle; determining for each cylinder a nominal fuel amount to be injected in this cylinder in a subsequent engine cycle; determining for each cylinder a correction coefficient of the nominal fuel amount to be injected in the cylinder in this subsequent engine cycle according to the quantity determined for this cylinder; correcting the nominal fuel amount to be injected in each cylinder according to the correction coefficient determined for the cylinder itself; and injecting into each cylinder the corresponding corrected fuel amount.

19 Claims, 2 Drawing Sheets

METHOD FOR BALANCING THE TORQUE GENERATED BY THE CYLINDERS OF AN INTERNAL COMBUSTION ENGINE, IN PARTICULAR A DIRECT-INJECTION DIESEL ENGINE PROVIDED WITH A COMMON RAIL INJECTION SYSTEM

BACKGROUND OF THE INVENTION

1. Field of the Invention

The present invention relates to a method for balancing the torque generated by the cylinders of an internal combustion engine.

In particular, the present invention can be applied advantageously but not exclusively to direct-injection diesel engines which are provided with a common rail injection system, to which the following description will refer explicitly without however detracting from generality.

2. Description of the Related Art

As is known, in the present internal combustion engines, the fuel amount injected in each engine cycle can vary, sometimes quite substantially, from one injector to another.

This injection imbalance is caused by various factors, the main ones of which can be the dispersion of the injector characteristics because of the so-called "spreads" of the production process, the drift over a period of time of the characteristics of the injectors, and the ageing of the injection system.

This injection imbalance is highly undesirable since it gives rise to a corresponding imbalance of the torque generated by the engine cylinders, which has a negative effect on the exhaust gas emission levels and on consumption.

BRIEF SUMMARY OF THE INVENTION

The object of the present invention is to provide a method for balancing the torque generated by the cylinders of an internal combustion engine, which makes it possible to overcome the above-described disadvantages.

This object is achieved by the present invention in that it relates to a method for balancing the torque generated by the cylinders of an internal combustion engine, characterized by:

- determining for each cylinder a quantity indicating the torque generated by the cylinder in a given engine cycle;
- determining, for each cylinder, a nominal fuel amount to be injected in said cylinder in a subsequent engine cycle;
- determining, for each cylinder, a correction coefficient for the nominal fuel amount to be injected in said cylinder in said subsequent engine cycle as a function of the quantity determined for said cylinder;
- correcting said nominal fuel amount to be injected in each cylinder as a function of said correction coefficient determined for said cylinder; and
- injecting into each cylinder the corresponding corrected fuel amount.

BRIEF DESCRIPTION OF THE SEVERAL VIEWS OF THE DRAWINGS

In order to assist understanding of the present invention, a preferred embodiment is now described, purely by way of non-limiting example, and with reference to the attached drawings, in which.

DETAILED DESCRIPTION OF THE INVENTION

Figure 1:
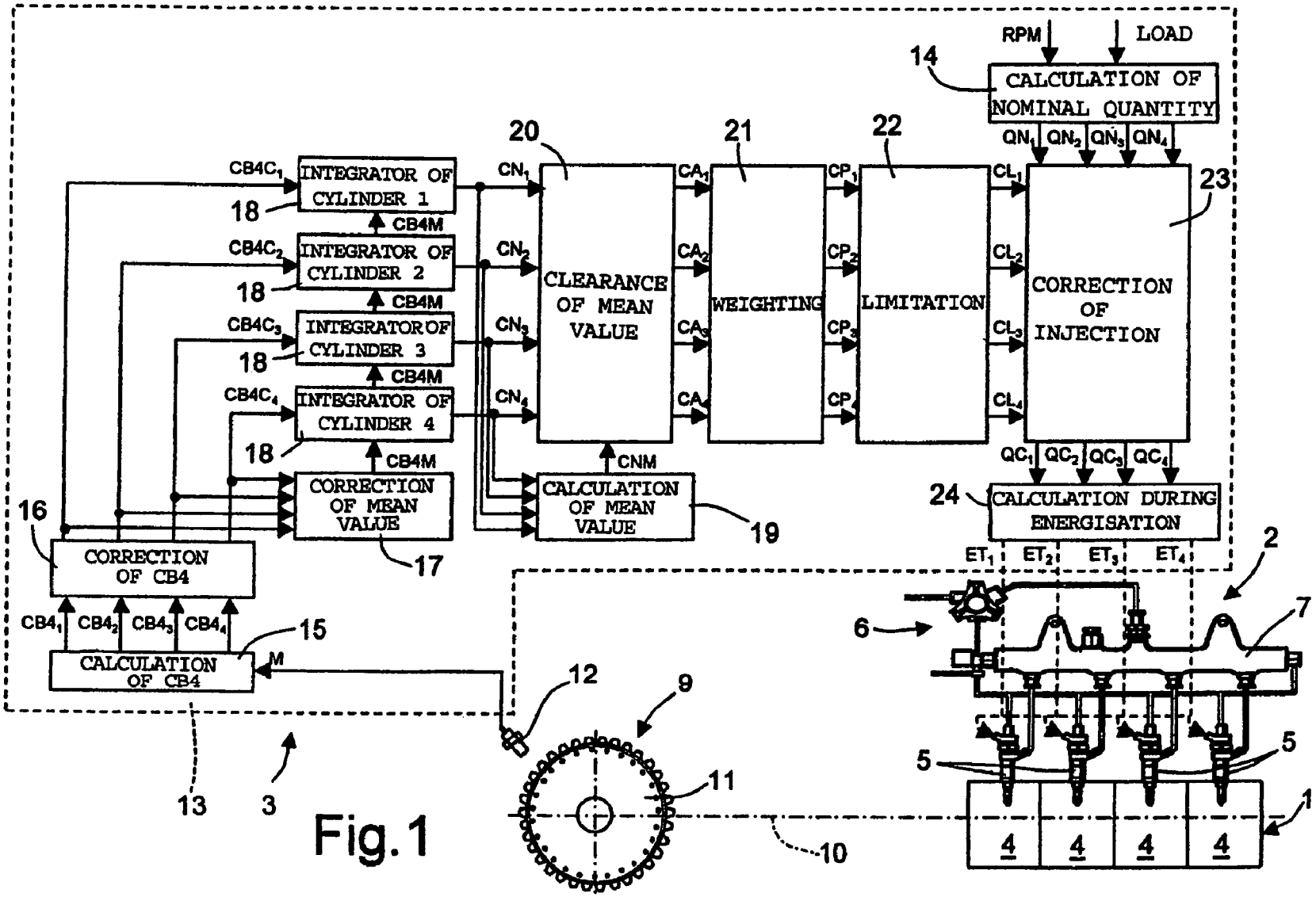
FIG. 1 shows a functional block diagram illustrating how the injection is controlled in an internal combustion engine using the balancing method according to the invention.

In FIG. 1, 1 indicates as a whole an internal combustion engine, in particular a diesel engine, which is provided with a common rail injection system 2 and an electronic control system 3 which can control the fuel amount to be injected in the engine 1 in each cylinder 4 of the engine 1 and in each engine cycle. In particular, FIG. 1 shows only the parts of the engine 1, of the common rail injection system 2 and of the electronic control system 3, which are strictly necessary for understanding of the present invention.

The common rail injection system 2 substantially comprises a plurality of electro-injectors 5 which supply fuel at a high pressure to respective cylinders 4 of the engine 1; a high-pressure supply circuit 6 comprising a common rail 7 which contains fuel at a high pressure for the electro-injectors 5; and a low-pressure supply circuit (not shown) which supplies fuel at a low pressure to the high-pressure supply circuit 6.

The common rail injection system 2 permits implementation of a fuel injection strategy which includes actuation of consecutive multiple injections in each engine cycle and in each cylinder 4 of the engine 1.

In particular, the common rail injection system 2 makes it possible to carry out in each engine cycle and in each cylinder 4 of the engine 1 of the following injections, depending on the type of effect to be obtained:

- a main injection MAIN, which is actuated around the top dead center of end of compression;
- a first pre-injection PILOT, which precedes the main injection and is actuated during the compression stage;
- a second pre-injection PRE, which precedes the main injection MAIN, and follows the first pre-injection PILOT;
- a first post-injection AFTER, which follows the main injection MAIN; and
- a second post-injection POST which follows the first pre-injection AFTER.

In particular, the second pre-injection PRE and the first post-injection AFTER are generally actuated sufficiently close to the main injection MAIN to participate together with the latter in the actual stage of combustion of the fuel.

For a more detailed description of the subject of multiple injections, see for example European patent application 00104651.5 filed on Mar. 3, 2000 by the applicant and published on 13.09.2000 under number EP-A-1 035 314, which is considered to be incorporated here in its entirety for the purpose of reference.

With reference once again to FIG. 1, the electronic control system 3 comprises inter alia a device 9 for instantaneous detection of the speed and angular position of the engine shaft 10 (illustrated schematically with a dot-and-dash line), which comprises a phonic wheel 11 of a known type keyed onto the engine shaft 10 and an electromagnetic sensor 12 of a known type which faces the phonic wheel 11 and generates a movement signal M which indicates the speed and angular position of the engine shaft 10.

In the example illustrated in FIG. 1, the phonic wheel is a toothed wheel which has toothing with 60 teeth, wherein two teeth are missing, i.e., it is a wheel which is provided on its outer periphery with 58 identical teeth which are spaced from one another by an angular step of 6 degrees, and wherein the first and last teeth are separated from one another by three steps, i.e., 18 degrees.

The electronic control system 3 additionally comprises an electronic control system 13 which is connected to the detection device 9 and generates piloting signals for the electro-injectors 5.

Amongst the many operations carried out, the electronic control system 13 also implements an algorithm for balancing of the torque generated by the cylinders 4 of the engine 1, the purpose of which is essentially to correct in each engine cycle the point of functioning of the electro-injectors 5 on the basis of the torque actually generated by the engine cylinders.

In particular, as shown in FIG. 1, the electronic control system 13 firstly implements a first calculation block 14, which receives as input parameters which indicate the power which the driver requires from the engine 1, such as the speed and load of the engine, and calculates for each cylinder a nominal fuel amount QN to be injected in each engine cycle according to the power required. If there is use of an injection strategy which requires implementation of multiple injections, the first calculation block 14 supplies as output the fuel amount to be injected into each cylinder 4 in each individual injection, according to the injection strategy to be actuated.

In a stationary condition, the nominal fuel quantities QN calculated for the different cylinders 5 will be the same as one another, whereas in a transit situation the nominal quantities of fuel QN will be different from one cylinder to another, depending on the power required.

The electronic control system 13 implements a second calculation block 15, which receives as input the movement signal M supplied by the detection device 9, and calculates for each cylinder a current index CB4 which indicates the torque generated by the combustion of the fuel in that specific cylinder 4.

In particular, the second calculation block 15 processes the movement signal M in detail in the manner described hereinafter, and for each engine cycle supplies a current index CB4 for each cylinder.

Many methods have been proposed hitherto for calculation of the current indices CB4. One which is particularly suitable for the purpose is described for example in European patent application 92402482.1 filed on Nov. 9, 1992 and published on 17.03.1993 under number EP-A-O 532 419, which is considered to be incorporated here in its entirety for reference purposes.

To summarize, as described in this patent application, each current index CB4 is calculated on the basis of the value assumed by the harmonic content of second order of the instantaneous speed of the engine, which is closely correlated to the development of the pressure in the combustion chamber derived from combustion of the quantity of fuel injected.

The extent of the harmonic content of second order is measured by means of corresponding weighting of the times taken by the engine shaft to travel the 30 intervals of 6 degrees of the phonic wheel during the stage of expansion of the cylinder concerned. By this means, each current index CB4 will be available only during the stage of discharge of the corresponding cylinder 4.

In particular, each current index CB4 can be calculated by using the following formula:

$$CB4 = CoefA(n, Q_{FUEL}) \cdot S0 \cdot \left(\frac{1}{T_{m360}}\right)^3 + CoefB \cdot \left(\frac{1}{T_{m360}}\right)^2 + CoefC \cdot \left(\frac{1}{T_{m360}}\right)$$

wherein:

SO is the harmonic content of second order of the instantaneous speed of the engine rotation;

Coif is a map of coefficients of correlation of the harmonic content of second order, to the torque distributed by each individual combustion operation, which depends on the engine rotation speed and fuel amount injected;

CoefB, CoefC are calibration coefficients; and $T_{m360}$ is the mean revolution time taken by the engine shaft to complete the 180 degrees concerned by the fuel being analyzed.

The measurements of the aforementioned time intervals on which the calculation of the current indices CB4 is based are affected by both systematic and random errors, to which there are added all the vibrations and oscillations which affect the engine.

For this reason, the electronic control system 13 implements a correction block 16, which receives as input the current indices CB4 calculated by the second calculation block 15, and clears from them the systematic errors and geometric errors caused by the tolerances in production and fitting of the phonic wheel 11, thus providing as output a corrected index CB4C for each cylinder 4.

In particular, the errors which affect the calculation of the current indices CB4 are eliminated by analyzing the values assumed by the current index CB4 for the different cylinders during the release maneuvers. In fact, since the current index CB4 is correlated to the combustion torque of the cylinders, during these maneuvers, for the same engine speed and in the lack of systematic errors, the current indices CB4 for the different cylinders must necessarily coincide.

Thus, in order to align the current indices CB4 for the different cylinders, every $n_{cyl}/2$ engine revolutions, wherein $n_{cyl}$ is the number of cylinders 4 of the engine 1, and is four in the example illustrated, there is calculation of the systematic errors, as the difference between the current indices CB4 of the different cylinders and their mean value.

Figure 2:
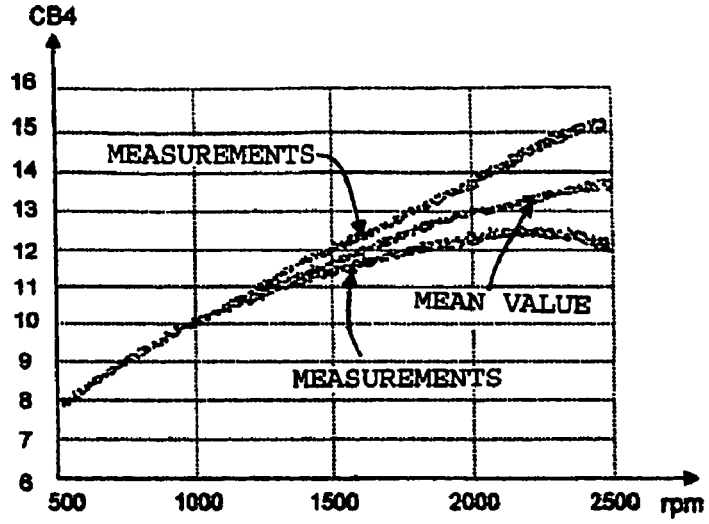
FIGS. 2, 3 and 4 show graphs relating to a method for elimination of systematic and geometric errors which forms part of the balancing method according to the present invention.

By way of example, FIG. 2 shows the measurements of the current indices CB4 for the various cylinders 4 during a maneuver of release in a real case, and their mean value.

Figure 3:
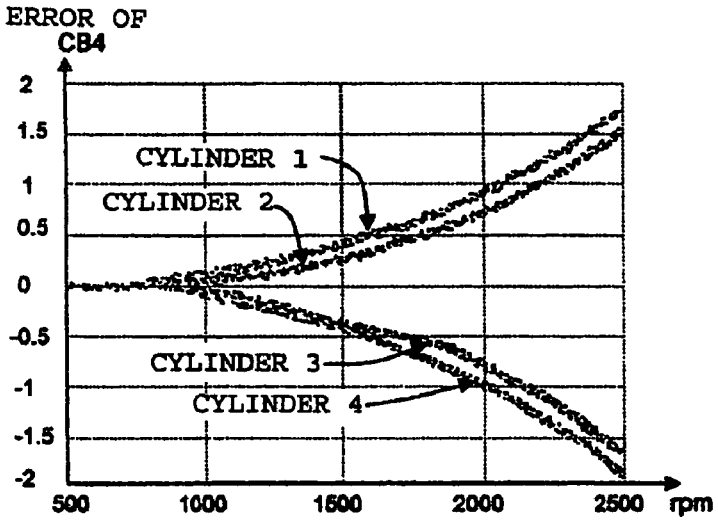

The systematic errors for the various cylinders 4 are thus stored in $n_{cyl}$ vectors according to the engine speed (FIG. 3). Apart from the release maneuvers, each index CB4 is thus corrected by adding the value obtained with interpolation of the corresponding correction vector according to the engine speed.

Figure 4:
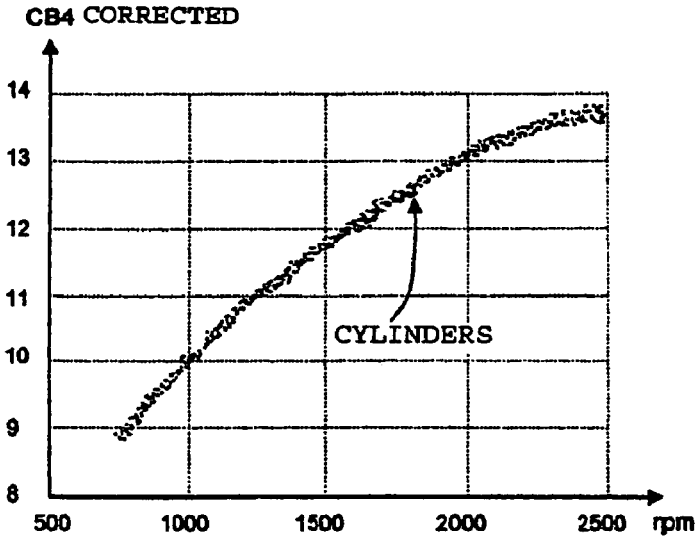

This therefore compensates for the systematic errors, by obtaining in the case of release correct realignment of the values of the current index CB4 (FIG. 4). Since the errors cannot be measured at low speeds, at which there is actuation of control of the minimum speed in order to prevent the engine 1 from cutting out, the values of the systematic errors are extrapolated correspondingly on the basis of the last value measured present in the correction vector.

On the other hand, as far as random errors are concerned, the oscillations and vibrations (which are assumed to have a mean value of zero) are eliminated by using the convergence time of the algorithm: this should be greater than the maximum period of these oscillations.

With reference once again to FIG. 1, the electronic control system 13 also implements a third calculation block 17, which receives as input the corrected indices CB4C supplied by the correction block 16, and, at the end of each engine cycle, calculates a mean index CB4M which is equal to the mean value of the corrected indices CB4C relating to the various cylinders in this engine cycle.

The electronic control system 13 also implements $n_{cyl}$ controller blocks 18 of an integral type, which are independent from one another, one for each cylinder 4, to each of which there is supplied as input, at each engine cycle, the corrected index CB4C calculated by the correction block 16 for the corresponding cylinder 4 in this engine cycle and the mean index CB4M calculated by the third calculation block 17 at the end of the preceding engine cycle, and each of which includes the difference between the corresponding corrected index CB4C and the mean index CB4M, thus supplying as output a respective coefficient of nominal correction CN to be used to corrected the fuel amount to be injected in this cylinder.

The $n_{cyl}$ controller blocks 18 can be calibrated by means of a parameter which represents the time of convergence of the controlled system towards the reference value.

The electronic control system 13 also implements a fourth calculation block 19, which receives as input the coefficients of nominal correction CN supplied by the $n_{cyl}$ controller blocks 18, and on completion of each engine cycle calculates a mean correction coefficient CNM which is equal to the mean value of the nominal correction coefficients CN relating to the various cylinders in this engine cycle.

The electronic control system 13 also implements a clearance block 20, which receives as input the nominal correction coefficients CN supplied by the four controller blocks 18 and the mean correction coefficient CNM supplied by the fourth calculation block 19, and supplies as output for each cylinder 4 a current correction coefficient CA as the difference between the corresponding nominal correction coefficient CN and the mean correction coefficient CNM.

The operations of clearance from the mean value, of the corrected indices CB4C and of the nominal correction coefficients CN, are used to guarantee that the corrections put into effect on the cylinders have a mean value of zero. By this means, the balancing algorithm does not affect the point of functioning of the engine, and does not interact with other control strategies in a closed chain. This latter requirement is important in order to guarantee satisfactory functioning of the engine which is controlled electronically, and a certain ease of calibration of the control parameters.

The electronic control system 13 also implements a weighting block 21, which receives as input the current correction coefficients CA supplied by the clearance block 20, and supplies as output, for each cylinder, a weighted correction coefficient CP.

This weighting operation is made necessary by the fact that, as previously stated, the corrections to be made to the nominal fuel amount to be injected in each cylinder are calculated in relation to a certain point of functioning of the engine (rate and fuel amount/torque required), but actuated in the subsequent engine cycle, and therefore at another point of functioning of the engine. Since the corrections required, i.e., those to be implemented in order to balance perfectly the torque generated in the different cylinders, vary according to the point of functioning of the engine, it is apparent that if the point of functioning of the engine remains in a relatively small area of the range in which the correction values were calculated, then the corrections can be considered valid and fully actuated. If this is not the case, on the other hand, the corrections must be considered to have been actuated only partially, or not at all.

In fact, when the point of functioning of the engine changes, the corrections calculated do not converge towards the new values instantaneously, but with the dynamics imposed by the controller blocks of an integral type. The corrections calculated thus do not refer to the point of functioning of the current engine, but to a "reference" point of functioning which can be obtained by developing the coordinates which determine the point of functioning of the engine with the same dynamics as the corrections calculated by means of a filter with a time constant which is the same as that at which all the corrections converge. On the basis of the "distance" between the current point of functioning of the engine and the "reference" point, there is selection, by means of a pair of maps with weighting which is generated experimentally, one for each coordinate of the point of functioning of the engine, of the percentage in which the corrections calculated must be actuated.

These weighting maps depend on the differences between the characteristics of the electro-injectors: the area of the "reference" point of functioning, with full actuation (weighting=1) consists of that in which a negligible error is committed by considering constant the differences between the characteristics of the electro-injectors. As the distance from the "reference" point of functioning increases, the latter hypothesis leads to creation of an increasing error; the corrections must therefore have an actuation weighting which decreases as the distance increases, up to the point where they are cancelled out (weighting=0) when the absolute value of the error is comparable to that of the corrections themselves.

The electronic control system 13 also implements a limitation block 22, which receives as input the weighted correction coefficients CP calculated by the weighting block 21, and limits the maximum value which can be assumed by the weighted correction coefficients CP, thus providing limited correction values CL. In particular, the limitation operation is carried out according to the fuel amount required by the injection system, and is used to prevent the introduction of non-linearity in functioning of the engine (for example elimination of an injection in a cylinder because of an excessively great negative correction).

The electronic control system 13 also implements a correction block 23, which receives as input the nominal quantity QN of fuel supplied by the first calculation block 14, to be injected in each cylinder, and the limited correction coefficients CL supplied by the limitation block 22, and calculates for each cylinder a correct fuel amount QC to be injected, by adding algebraically each limited correction coefficient CL and the corresponding nominal fuel amount QN.

Finally, the electronic control system 13 implements an energizing block 24, which receives as input the corrected fuel amount QC supplied by the correction block 23, to be injected in each cylinder 4, and supplies as output corresponding energizing signals ET for the electro-injectors 5.

According to a further aspect of the present invention, the algorithm for balancing of the torque generated by the cylinders of the engine is not implemented in the case in which the following deactivation conditions have occurred, which represent the conditions of functioning as a whole of the engine, in which the algorithm does not update and actuate the corrections.

In particular, the balancing algorithm is disabled in the following conditions:

during the stage of start-up of the engine;

during the stage of warm-up of the engine;

if the speed of rotation of the engine is excessively high or excessively low;

if the torque required from the engine is excessively high or excessively low; and in the case in which a correction value is not yet available for the current engine speed value.

Examination of the characteristics of the balancing method according to the present invention makes apparent the advantages which can be obtained by means of the invention.

In particular, by acting on the fuel amount injected by the electro-injectors, the invention makes it possible to balance the torque generated by the cylinders of the engine throughout the functioning plan of the engine, with obvious advantages in relation to the levels of emission of the exhaust gases and consumption, as well as to the standardization of the performance of engines which are equipped with common rail fuel injection systems.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method for balancing torque generated by cylinders of an internal combustion engine, the method comprising:

determining for each cylinder a quantity indicating the torque generated by the cylinder in a given engine cycle;

determining, for each cylinder, a nominal fuel amount to be injected in said cylinder in a subsequent engine cycle;

determining, for each cylinder, a correction coefficient for the nominal fuel amount to be injected in said cylinder in said subsequent engine cycle as a function of the quantity determined for said cylinder;

correcting said nominal fuel amount to be injected in each cylinder as a function of said correction coefficient determined for said cylinder; and injecting into each cylinder the corresponding corrected fuel amount;

detecting an occurrence of predetermined engine operating conditions; and disabling correction of the fuel amount to be injected into each cylinder upon occurrence of said predetermined engine operating conditions.

2. The method according to claim 1 wherein determining said correction coefficients comprises:

determining a mean value of the quantities determined for the different cylinders in a given engine cycle; and determining said correction coefficient for each cylinder as a function of said mean value and said quantity determined for said cylinder.

3. The method according to claim 2 wherein determining said correction coefficients for each cylinder as a function of said mean value and said quantity determined for said cylinder comprises:

integrating a difference between said mean value and said quantity determined for said cylinder, so generating a corresponding nominal correction coefficient.

4. The method according to claim 3, further comprising:

computing a mean value of said nominal correction coefficient; and clearing the mean correction coefficient from said nominal correction coefficients.

5. The method according to claim 1 wherein correcting the nominal fuel amount to be injected in each cylinder comprises:

correcting the nominal fuel amount to be injected in each cylinder also as a function of an engine operating point variation which occurs between the engine cycle in which said correction coefficients were determined, and the engine cycle in which said corrected fuel amount is injected into the corresponding cylinder.

6. The method according to claim 1 wherein correcting the nominal fuel amount to be injected in each cylinder further comprises:

limiting a maximum value which can be assumed by each correction coefficient.

7. The method according to claim 1 wherein correcting the nominal fuel amount to be injected in each cylinder as a function of the correction coefficient determined for said cylinder comprises:

adding algebraically each nominal fuel amount and the corresponding correction coefficient.

8. The method according to claim 1 wherein the correction of the fuel amount to be injected in each cylinder is disabled:

during engine startup;

during engine warmup;

when engine speed is excessively high or excessively low;

when the engine torque is excessively high or excessively low; and when a correction value is not yet available for a current engine speed.

9. The method according to claim 1 wherein determining for each cylinder a quantity indicating the torque generated by the cylinder in a given engine cycle comprises:

determining each of said quantities as a function of speed and angular position of the engine.

10. The method according to claim 9 wherein determining each of said values as a function of the speed and angular position of the engine comprises:

determining each of said quantities as a function of a time taken by the engine to complete a rotation corresponding to an expansion stroke in the cylinder associated with said quantity.

11. The method according to claim 1 further comprising:

correcting said quantities to eliminate systematic errors.

12. The method according to claim 11 wherein correcting said quantities to eliminate the systematic errors comprises:

computing said systematic errors as a function of said quantities during a release maneuver.

13. The method according to claim 12 wherein computing said systematic errors as a function of said quantities during a release maneuver comprises:

determining, during said release maneuver, said quantities in each engine cycle;

computing, in each engine cycle, a mean value of said quantities;

computing, in each engine cycle, a systematic error corresponding to each of said quantities, as a difference between said quantity and the mean value of said quantities in said engine cycle; and storing said systematic errors as a function of the engine speed at which said systematic errors have been computed.

14. The method according to claim 13 wherein correcting said quantities to eliminate systematic errors comprises:

computing, for each of said quantities and at each engine speed, a corresponding systematic error by interpolating the stored systematic errors corresponding to a said quantity as a function of the engine speed.

15. A method for balancing torque generated by cylinders of an internal combustion engine, the method comprising:

determining for each cylinder a quantity indicating the torque generated by the cylinder in a given engine cycle;

determining, for each cylinder, a nominal fuel amount to be injected in said cylinder in a subsequent engine cycle;

determining, for each cylinder, a correction coefficient for the nominal fuel amount to be injected in said cylinder in said subsequent engine cycle as a function of the quantity determined for said cylinder;

correcting said nominal fuel amount to be injected in each cylinder as a function of said correction coefficient determined for said cylinder;

injecting into each cylinder the corresponding corrected fuel amount; and correcting said quantities to eliminate systematic errors.

16. The method according to claim 15 wherein correcting said quantities to eliminate the systematic errors comprises computing said systematic errors as a function of said quantities during a release maneuver.

17. The method according to claim 16 wherein computing said systematic errors as a function of said quantities during a release maneuver comprises:

determining, during said release maneuver, said quantities in each engine cycle;

computing, in each engine cycle, a mean value of said quantities;

computing, in each engine cycle, a systematic error corresponding to each of said quantities, as a difference between said quantity and the mean value of said quantities in said engine cycle; and storing said systematic errors as a function of the engine speed at which said systematic errors have been computed.

18. The method according to claim 17 wherein correcting said quantities to eliminate systematic errors comprises computing, for each of said quantities and at each engine speed, a corresponding systematic error by interpolating the stored systematic errors corresponding to a said quantity as a function of the engine speed.

19. A method for balancing torque generated by cylinders of an internal combustion engine, the method comprising:

determining for each cylinder a quantity indicating the torque generated by the cylinder in a given engine cycle;

determining, for each cylinder, a nominal fuel amount to be injected in said cylinder in a subsequent engine cycle;

determining, for each cylinder, a correction coefficient for the nominal fuel amount to be injected in said cylinder in said subsequent engine cycle as a function of the quantity determined for said cylinder, wherein determining said correction coefficients includes:

a) determining a mean value of the quantities determined for the different cylinders in a given engine cycle; and b) determining said correction coefficient for each cylinder as a function of said mean value and said quantity determined for said cylinder, by integrating a difference between said mean value and said quantity determined for said cylinder, so generating a corresponding nominal correction coefficient;

correcting said nominal fuel amount to be injected in each cylinder as a function of said correction coefficient determined for said cylinder;

injecting into each cylinder the corresponding corrected fuel amount;

computing a mean value of said nominal correction coefficient; and clearing the mean correction coefficient from said nominal correction coefficients.

* * * * *